United States Patent [19]

Hayes-Pankhurst et al.

[11] Patent Number: 4,839,474

[45] **Date of Patent: * Jun. 13, 1989**

[54] SWITCHES AND KEYBOARDS

[75] Inventors: Richard P. Hayes-Pankhurst; Brian D. Smith, both of London, United Kingdom

[73] Assignee: Key Innovations Limited, London, United Kingdom

[ * ] Notice: The portion of the term of this patent subsequent to Jan. 6, 2004 has been disclaimed.

[21] Appl. No.: 131,630

[22] Filed: Dec. 10, 1987

Related U.S. Application Data

[63] Continuation-in-part of Ser. No. 897, Jan. 6, 1987, abandoned, which is a continuation-in-part of Ser. No. 783,927, filed as PCT GB85/00049 on Feb. 4, 1985, published as WO85/03595 on Aug. 15, 1985, Pat. No. 4,634,818.

[30] Foreign Application Priority Data

Feb. 3, 1984 [GB] United Kingdom ..... 8402974

[51] Int. Cl.[4] ..... H01H 13/70

[52] U.S. Cl. ..... 200/5 A; 200/513

[58] Field of Search ..... 200/5 R, 5 A, 86 R, 200/159 B, 309, 314, 317, 329, 340

[56] References Cited

U.S. PATENT DOCUMENTS

| | | | |
|---|---|---|---|
| 3,054,879 | 9/1962 | Soreng | 200/159 B |
| 3,699,294 | 10/1972 | Sudduth | 200/86 R X |
| 3,728,509 | 4/1973 | Shimajo | 200/159 B |
| 3,760,137 | 9/1973 | Shimojo et al. | 200/159 B X |
| 3,761,944 | 9/1973 | Shimojo | 200/159 B X |
| 3,932,722 | 1/1976 | Obata | 200/340 |
| 4,081,631 | 3/1978 | Feder | 200/340 X |
| 4,127,758 | 11/1978 | Lowthorp | 200/159 B X |
| 4,343,975 | 8/1982 | Sado | 200/314 |
| 4,378,478 | 3/1983 | Deeg | 200/340 X |
| 4,421,966 | 12/1983 | Pounds | 200/309 |
| 4,491,702 | 1/1985 | Kato | 200/159 B |
| 4,532,575 | 7/1985 | Suwa | 200/5 A X |
| 4,536,625 | 8/1985 | Bebie | 200/5 A |
| 4,634,818 | 1/1987 | Hayes-Parkhurst et al. | 200/5 A |

FOREIGN PATENT DOCUMENTS

| | | |
|---|---|---|
| 123184 | 10/1984 | European Pat. Off. . |
| 2540011 | 3/1976 | Fed. Rep. of Germany . |
| 3218404 | 11/1983 | Fed. Rep. of Germany . |
| 871287 | 4/1942 | France . |
| 2082840A | 3/1982 | United Kingdom . |

OTHER PUBLICATIONS

Electronic Design; Ed Connolly; "Focus on Membrane Switches: Simple, Colorful, and Reliable"; vol. 30, Sep. 1982, pp. 183–192.

*Primary Examiner*—J. R. Scott

*Attorney, Agent, or Firm*—Shoemaker and Mattare

[57] ABSTRACT

A low profile switch or keypad has one or more touch buttons of circular or polygonal shape in plan formed integrally with and raised from a surrounding membrane of elastomeric material by a wall of resiliently deformable material of thickness and angle relative to the membrane so that the wall can flex under finger pressure on the or each button without deflecting the surrounding membrane. The membrane and at least the periphery of the button are relatively thick and the wall is relatively thin so that deformation during the keystroke is localized in the wall. The length of the wall is about equal to the keystroke and is relatively small compared to the width of the touch button. The junction between the wall and the membrane is located a distance greater than the keystroke above the lower surfaces of the membrane so that the wall passes overcenter during the keystroke resulting in a change in tactile sensation. The underside of each touch button is preferably formed with a convex contact pad dimensioned in relation to the button diameter and travel and the length of wall so that the contact pad makes surface to surface contact with conductors of an underlying circuit board.

30 Claims, 5 Drawing Sheets

SWITCHES AND KEYBOARDS

FIELD OF THE INVENTION

This application is a continuation-in-part of U.S. application Ser. No. 000897, filed Jan. 6, 1987, now abandoned, which in turn is a continuation-in-part of U.S. application Ser. No. 783927, filed as PCT GB85/00049 on Feb. 4, 1985, published as WO85/03595 on Aug. 15, 1985, now U.S. Pat. No. 4,634,818.

The present invention relates to a keypad for an electrical switch and to a switch using such a keypad that may be used, e.g. for the input of data to an electronic device such as a digital device.

BACKGROUND OF THE INVENTION

The cost of digital data processing circuitry has fallen spectacularly since computers began to be mass produced and this cost reduction has exerted a corresponding downward pressure on the cost of peripherals such as keyboards.

A conventional typewriter-type keyboard has moving keys controlling individual switches, but is relatively expensive to make. A membrane keyboard such as has been fitted to the Sinclair ZX 81 microcomputer enables substantial cost reductions to be made but provides no tactile feedback to the user as to whether depression of a key has provided a registrable signal. In other low cost computers such as that fitted to the Sinclair Spectrum the keys are formed integrally with a molded rubber membrane. But the rubber sheet has to be overlaid by an apertured cover plate or bezel and the keys are used to close contacts in a membrane-type grid supported by a backing plate which is still relatively complex. Keyboards using silicone rubber sheets bearing conductive pads resiliently supported in contact elements formed in the sheets that directly close circuits between conductors on an underlying circuit board are sold by Maag Technic AG and provide a snap action and hence a degree of user tactile feedback. But again the silicone sheet is concealed within the keyboard structure and is intended to be used with separate typewriter- or calculator-style keys working in a guiding bezel. The key may either itself project through the bezel or a plastics keytop placed over the key may project through the bezel.

German OLS 3218404 describes a keypad with raised dome keys but little information is given about the effective design of the dome walls. Membrane switches are also described by Ed. Connolly in Electronic Design, Volume 30, Sept. 30, 1982 at pages 183–192.

SUMMARY OF THE INVENTION

It is an object of the invention to provide an improved keypad for an electrical switch enabling a keyboard or other device of simplified construction using essentially only two interfitting parts—one being the keypad—which is of attractive low profile appearance and provides a tactile response to key depression.

Broadly stated the invention provides a keypad for an electrical switch comprising a membrane of resiliently deformable material having an integrally formed dome key whose top surface constitutes a touch button joined to the membrane by a frusto-conical wall, wherein:

(a) the membrane and at least the periphery of the touch button are relatively thick and the wall is relatively thin so that deformation during the key stroke is localised in the wall;

(b) the length of the wall is approximately equal to the keystroke; and (c) the junction between the wall and the membrane is located at a distance less than the keystroke below the junction between the wall and the key so that the wall passes overcenter during the keystroke resulting in a change in tactile sensation.

With the arrangement just described the wall exhibits a true overcenter action, i.e. the junction between the wall and the button passes from above to below the junction between the wall and the membrane resulting in a sharp and noticeable difference in tactile sensation.

The invention also provides a two component switch wherein a keypad as aforesaid is in face to face contact with a contact surface, the top face of the keypad providing an outer face for the switch without the need for an alignment bezel.

The invention further provides a keypad for an electrical switch consisting of a membrane of resiliently deformable material having at least one frusto-conical dome-shaped key molded therein so that its top surface constitutes a touch button, the thickness and angle of the or each dome side wall relative to the touch button and the membrane being such that irrespective of the angle to which the touch button tilts when depressed the unsupported wall gives way to give a change in tactile sensation without substantially deforming the surrounding membrane, the thickness of the membrane being greater than the distance the button tilts or travels before the respective side wall gives way.

DESCRIPTION OF PREFERRED FEATURES

The junction between the wall and the membrane is desirably located at a distance greater than the keystroke above the lower surface of the membrane and the distance should be such that the wall is not significantly tensioned before the keystroke is complete.

The relative thicknesses of the wall and the membrane have to be selected in relation to the structure and material of the keypad so that deformation during the keystroke is localised in the wall and neither the key nor the surrounding membrane distorts perceptibly to the user. The ratio of the thickness of the membrane to the thickness of the wall is therefore desirably from about 4:1 to about 10:1; most usually about 7:1. The wall may be directed at an angle of from 25° to 60° to the membrane when the touch button is undeflected depending upon the tactility required, with angles of about 45° being preferred.

The touch button may in plan be circular or oval but preferably polygonal with radiused corners, square or rectangular keys being the most common. The polygonal key shape has been found to retain tactility well under asymmetric finger pressure, the wall part that travels furthest collasping overcenter all along its length and the opposite wall part acting as a hinge with the intervening wall parts exhibiting intermediate behavior.

Embodiments of the invention will now be described by way of example only with reference to the accompanying drawings, in which:

BRIEF DESCRIPTION OF DRAWINGS

FIGS. 6*a* to 6*e* show the keypad of FIG. 4 at successive positions of key travel under asymmetric pressure.

DETAILED DESCRIPTION OF PREFERRED EMBODIMENT

Figure 1:
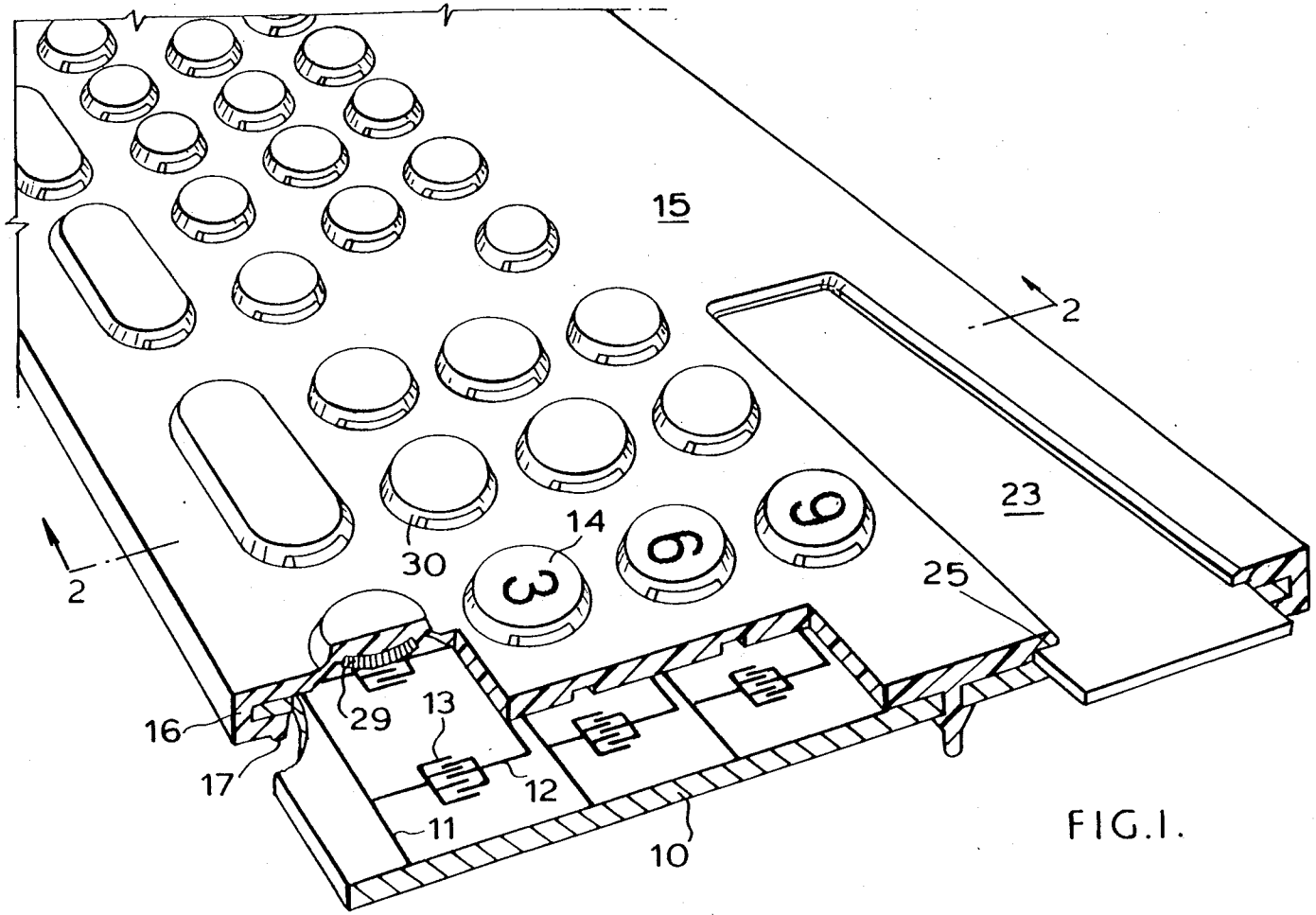
FIG. 1 is a perspective view of a first form of a keypad and keyboard PCB according to the invention.
Figure 2:
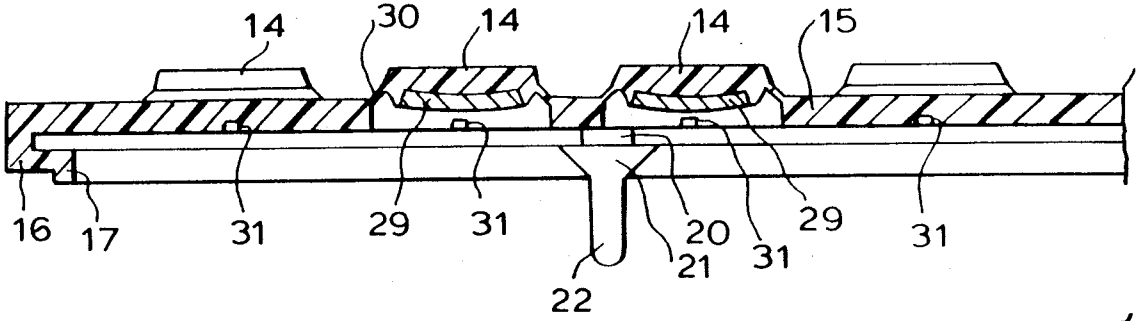
FIG. 2 is a fragmentary section of the keypad on the line 2—2 of FIG. 1.

In FIG. 1 a printed circuit board 10 for a keyboard according to the invention has on its top face an array of conductors including row conductors 11 and column conductors 12 that define a matrix within which there are contact areas 13 corresponding to each touch button 14 in an overlying key membrane 15. It will be noted that each contact area 13 comprises an interlaced array of conductive fingers, in this instance a three-pronged fork entering a four-pronged receptacle. The purpose of this interleaved array is to provide an area which is comparable to that of the overlying touch button 14 within which contact may be made to signal that the key has been depressed.

The keypad membrane 15 is a molding in an elastomeric material such as silicone rubber or a rubber-modified polyurethane that when untensioned is of slightly lesser width and length than the circuit board 10. It has an integrally molded peripheral lip 16 that has at its extremity a depending rim 17. The lip 16 can be engaged with the edges of the board 10 to retain the membrane 15 in a predetermined location thereon with the membrane 15 in tension both longitudinally and transversely. The advantage of this arrangement is that molding tolerances in the membrane 15 are substantially cancelled out when the membrane 15 is fitted to the board 10 and each touch button 14 overlies the respective contact area 13 to a sufficient degree of accuracy to be serviceable. Furthermore the rim 17 is stretched to accurate predetermined dimensions so that it will locate properly in a recess in a chassis member to which the keyboard is to be secured. The rigidity of the PCB 10 should be such that the keyboard assembly is self-supporting and does not require external reinforcement and the touch buttons 14 are maintained in stable positions without the need for an alignment bezel to be present as in conventional calculators and in membrane-type keyboards such as that of the Sinclair Spectrum.

Depending upon the overall dimensions of the keyboard it may be desirable to provide location and retaining means at intermediate positions widthwise and lengthwise thereof. Accordingly the board 10 is provided at appropriate positions with a pattern of location points in the form of through holes and the membrane 15 has a complementary pattern of locating studs. Each stud comprises a shank 20 that fits into the respective through hole, a retaining head or mushroom 21 and a depending finger 22 by which the head 21 can be pulled through the through hole.

The board 10 and keypad membrane 15 may be apertured to accommodate a window 23 for a display device such as a liquid crystal or LED display. The window 23 is preferably cemented, e.g. by silicone cement, into a recess 25 in the underside of membrane 15. It will be appreciated that in the present arrangement the exposed face of the keyboard is a continuous sheet of elastomer interrupted only by any non-moving windows 23 about which there is an effective seal so that the assembly is protected from the ingress of moisture and dirt. Between the touch buttons 14 the exposed face of the membrane 15 is pulled smooth by the slight tension therein and where the substrate 10 is a printed circuit board the membrane 15 should be at least 1.5 mm thick so that soldered component leads in the top face of board 10 or other protuberances can be concealed in recesses let into the lower face of the membrane 15, as can air channels (described below) between the keys. The thickness of the membrane 15 is also related to the intended stroke of the touch buttons 14 and the requirement for an overcenter action as described below. The touch buttons 14 may have printed or molded-in legends and legends such as a manufacturer's logo may be molded into blank areas of the membrane 15. It will be appreciated therefore that a keyboard having any number of touch buttons and the appropriate windows together with other indicia may be formed at a single molding operation.

As is apparent from the foregoing the touch buttons 14 are operated by depression thereof and have conductive pads 29 or layers of printed-on conductive ink on their undersides that when brought into contact with the contact areas 13 make a circuit between at least one pair of the interlaced contact fingers, so that a state corresponding to the identity of the depressed touch button is caused to exist in the row and column conductors 12, 13. A conductive surface 29, e.g. of graphite filled rubber may be provided as a disk that is inserted into the mold for the membrane 15 and is molded into the underside of each touch button 14 or the touch button 14 may be molded as a whole and a conductive ink printed on afterwards. Each button 14 may be of circular or other shape, e.g. or it may be square or rectangular in shape with rounded corners, the latter shape being preferred for better asymmetric tactility, has substantially the thickness of the membrane 15 and stands slightly proud as shown. It is joined to the body of the membrane 15 by means of a wall 30 of thinner material which when viewed in section is straight and directed at approximately 45° to the body of the membrane 15. The steeper the angle is above 45° the harder it is to depres the key and conversely the shallower the angle the easier it is, wall angles from 25° to 60° being envisaged as suitable for most purposes. The wall 30 should be thin enough that deformation when the touch button is actuated is almost entirely concentrated therein; for this purpose the wall 30 desirably has no more than one fifth of the thickness of the membrane 15. As the button 14 is depressed the wall 30 exhibits an overcenter action such that depression of the button beyond its mid travel will with high probability result in the pad 29 contacting the area 13. For a user to have the best sensation of touch button movement, the travel of button 14 should be in excess of 1 mm and typically 1.3–1.4 mm. To achieve this movement combined with an overcenter action, the general thickness of membrane 15 should be substantially greater than the travel distance in order that the overcenter action can occur in a wall 30 of minimum length. Too thin a membrane 15 or too small a distance between the junction of wall 30 and membrane 15, and the lower surface of membrane 15 requires an unacceptably long wall 30 permitting the button 14 to overbalance under asymmetric finger pressure, and a thin membrane 15 distorts during button actuation which is unsightly. It has been found by experiment that the most effective overcenter action is obtained when the wall 30 is about the same length as the keystroke. The thickness of the wall 30 is also selected to give the desired tactile feedback to the keyboard operator. The shape of the button 14 and wall 30 section is selected to avoid stress concentrations resulting in fatigue by radiusing the upper and lower ends of the wall so that they fair in to the membrane 15 and button 14.

The touch button 14 is of relatively low profile. Material above the wall 30 is required only to provide stiffness to the button 14 so that it does not bend in the middle before the wall 30 has collapsed. The larger the button diameter, the more thickness of rubber is required above the top of the web to provide the required stiffness; too much height of material leads to instability under asymmetric finger pressure.

The underside of the pad 29 is convex with a large radius of curvature that is also appropriate to the key travel and size so that it will touch the contact area 13 tangetially, i.e. surface to surface, and not edge to surface, irrespective of whether or not the button 14 loses its proper attitude when it is depressed. Therefore the keyboard operator can strike the button 14 off-center and still make an effective contact, the large contact area of the conductive pad 29 which occupies substantially the whole undersurface of button 14 cooperating with the inter-digited tracking to achieve this result. Furthermore it has been found that the material of the button 14 is less likely to intrude onto the working face of the pad 29 during the molding process when using conductive pads and if the pad 29 is convex as shown, so that the reject rate is reduced. Air grooves 31 let into the lower face of the membrane 15 interconnect the several buttons 14 to permit displacement of air from under the key and air return so that the key travel takes place unimpeded.

Figure 3:
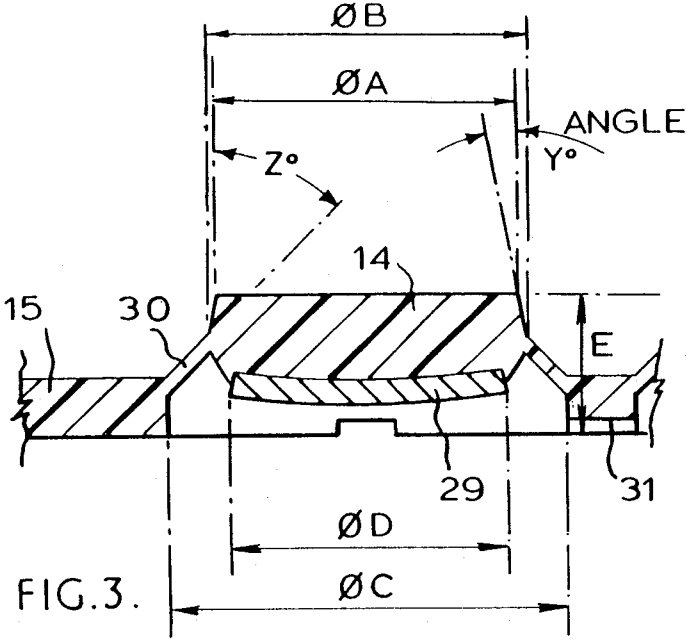
FIG. 3 is an enlarged fragmentary view of the keypad of FIG. 1 that is sectioned in the region of a single key.

In FIG. 3 the functional relationships between the various parts of an individual switch are apparent in a practical example. The keypad membrane 15 has a ground portion 2.25 mm thick in which are let air passages 31 that are 0.5 mm high. The touch button top diameter $\phi A$ is in this instance 10 mm and it is tapered to a rim outside diameter $\phi B$ of 11 mm. The wall 30 is of length 1.4 mm and thickness 0.33 mm–0.37 mm and the base diameter $\phi C$ of the cavity underlying the touch pad 14 is 13 mm. The diameter $\phi D$ of the conductive pad 29 under the key 14 is 9.1 mm, $\phi D$ having preferably the maximum value in relation to $\phi C$ that is permitted by the molding considerations. It will be noted that the maximum thickness or depth of the touch button 14 and pad 29 is 3.3 mm which is less than half the diameter $\phi A$ of the button 14, and the distance between the top face of button 14 and the lower face of membrane 15 is 4.75 mm which is less than three times the thickness of the membrane 15, the thickness of the button 14 being such that it does not substantially flex during the keystroke. The convex surface of the pad 29 has a radius of curvature of 34 mm. The touch button 14 and pad 29 are 3.3 mm deep and the overall key height E is 4.75 mm. The undersurface 29 of the touch button 14 is no higher than the top surface of the membrane 15 when the button 14 is undeflected. The travel between the pad 29 and the underlying conductor is about 1.3 mm.

It will be appreciated that the above construction is readily adaptable to making keyboards of a variety of shapes, key numbers and key positions, and can incorporate buttons of different tactility so that, e.g. the numeric keys are stiffer than the alphabetical keys.

Figure 4:
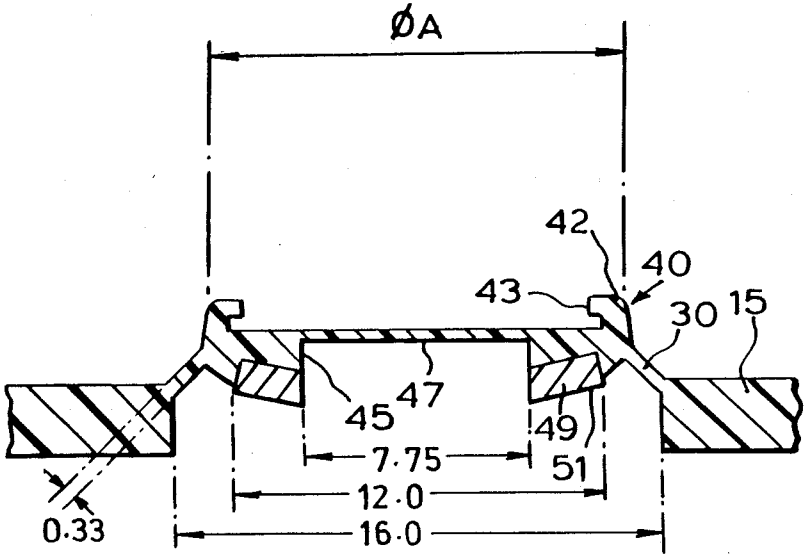
FIG. 4 is an enlarged fragmentary sectional view of a second form of the keypad in which the key is square with radiused corners in plan and can be back-lit.

A second form of the keypad is shown in FIG. 4 which is a section of a square key with rounded corners that is adapted for use in association with a board 10 carrying a surface mounted light-emitting diode (not shown) in the region of the inter-digitated conductive fingers of the contact area 13 for the purpose of backlighting each individual touch button 40. The top dimension $\phi A$ of the button 40 is 13.5 mm and it is connected by wall 30 of length 1.4 mm and thickness 0.3 mm$\pm$0.04 mm to a membrane 15 that is 2.25 mm thick. The key travel is 1.4 mm. The key top has an upstanding wall 42 terminating at an inturned region 43 that defines a recess for fitting a transluscent identifier disk (not shown) of rigid plastics material. The base of the button 40 is formed with a central cavity so that the button 40 has a relatively thick annular or frame-like periphery closed off by a thin integral web 47 which maintains fluid-tightness but is transluscent because of its thinness. If desired, the web 47 may be omitted for extra clarity but this structure is not preferred because fluid tightness is lost. The underside of the button 40 is provided with a molded-in contact annulus 49 having a convex curved lower face 51 as described previously. Because the span from inner to outer edge of the annulus 49 is relatively small, it is believed that an angled flat lower face of annulus 49 would be satisfactory, the face sloping inwardly and downwardly and mimicking a curved face over its relatively small span. The thickness of the web 47 is similar to or less than that of the wall 30 and web 47 transmits light because of its thinness even though the material appears opaque in thick sections. The distance from the top face of membrane 15 to the top face of web 47 when the key is undeflected is 1.65 mm and the distance from the underside of the web 47 to the top of the rim wall 42 is 4.8 mm. The external dimension of the pad 49 is 12 mm and the external dimension of wall 30 where it joins web 47 is 16 mm. The distance between the top face of web 47 and the lowest point on annulus 49 is 2.5 mm (2.25+1.65−1.4), which is only 18% of the width $\phi A$ of the key 42, indicating the low key profile. As discussed above, the height of the keypad is governed by the amount of material above the web to make the button 40 stiff enough that it does not bend in the middle before the wall 30 has fully collasped. In the backlit version of FIG. 4, the presence of a rigid clear plastics sheet snapped into the recess defined by rim wall 42 and inturned region 43 provides the needed rigidity without increasing the height of the button. As an alternative to a clear plastics sheet there may be produced a molding in which there is a clear rubber slug integrally molded into the button.

The central cavity in button 40 enables a surface mounted LED or other light source to be positioned centrally within the button 40 so that the button 40 can be illuminated. The provision of this cavity has been found not materially to affect the performance of the button 40. When the button 40 is depressed from one side the annulua 49 makes the same face to face contact with the substrate as the pad 29 in the earlier form. When the button 40 is depressed along the line of its axis then the travel distance is increased slightly compared to the earlier form because the central region of pad 29 is absent and the pad 29 makes annular rather than distributed point contact with the substrate.

Figure 5A:
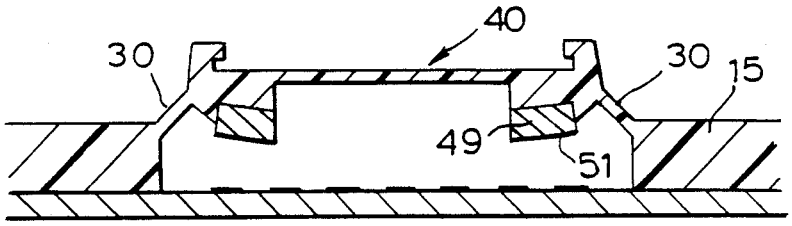
FIGS. 5*a* to 5*e* show the keypad of FIG. 4 at successive positions of key travel under axial pressure.
Figure 5B:
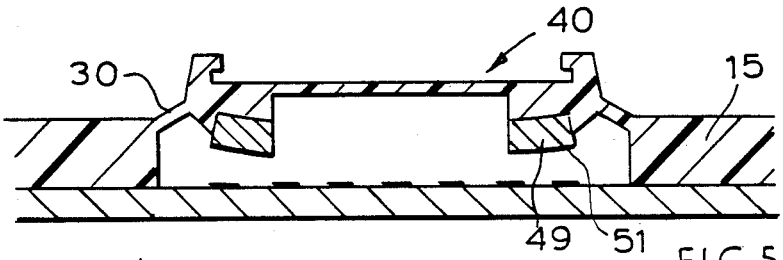
Figure 5C:
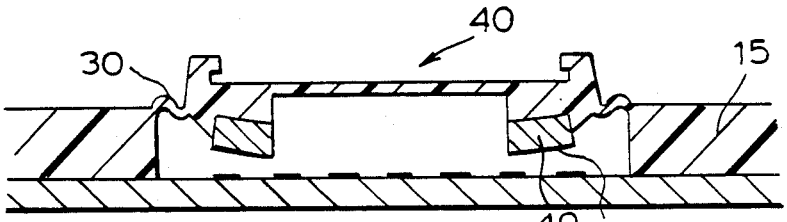
Figure 5D:
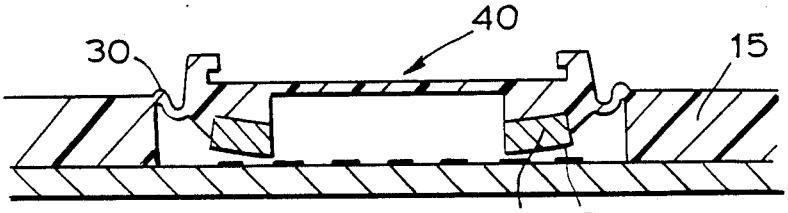
Figure 5E:
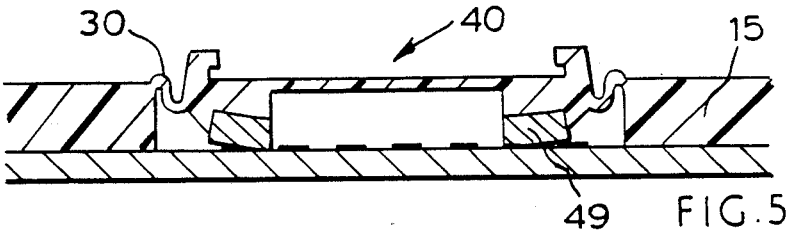
Figure 6A:
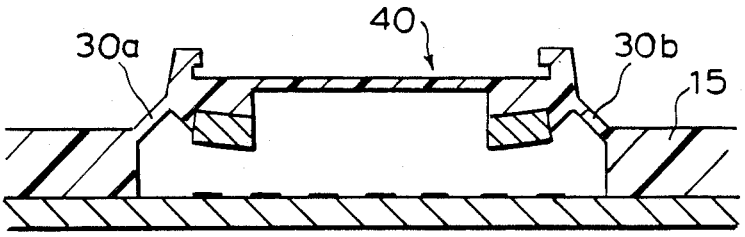
Figure 6B:
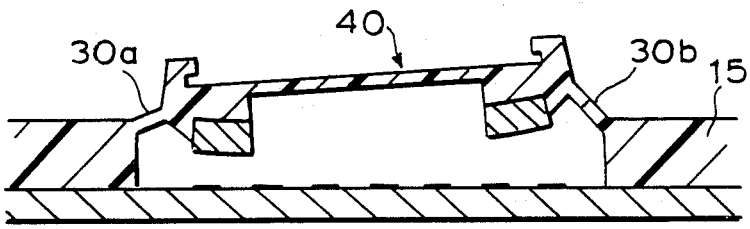
Figure 6C:
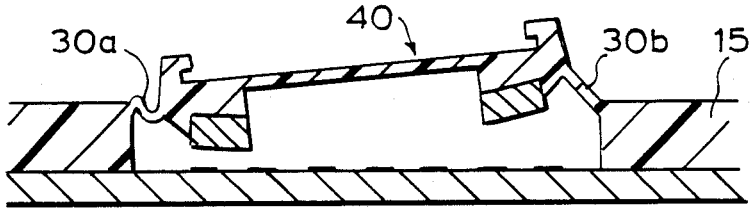
Figure 6D:
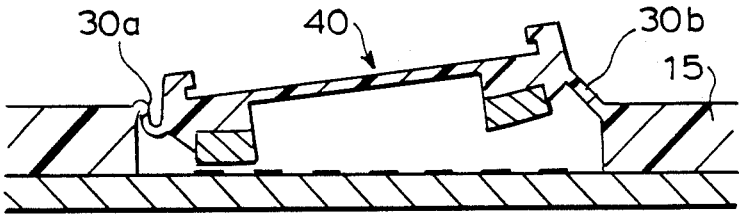
Figure 6D:
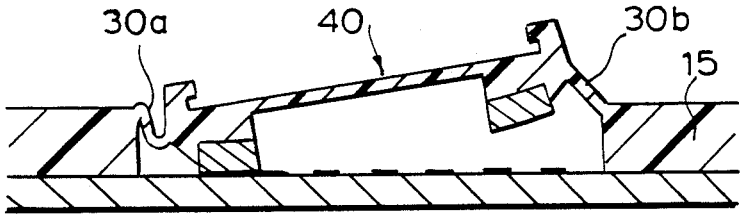
Figure 7:
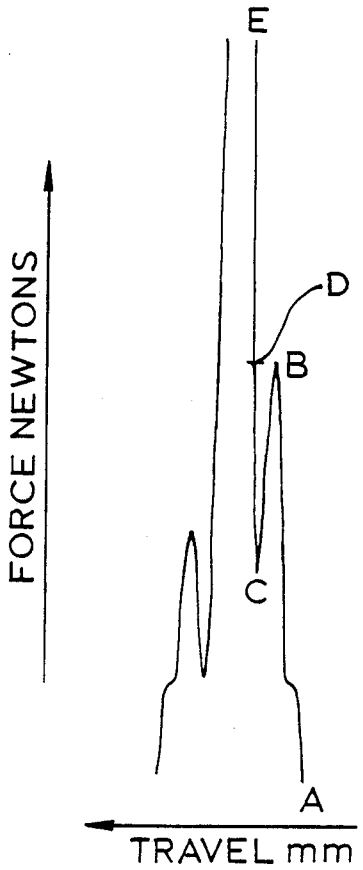
FIG. 7 is force/travel curve for the key of FIGS. 2 or 4.

The behaviour of the wall 30 under idealised axial load is illustrated in FIGS. **5*a*–5*e* and may be understood with reference to FIG. 7. The curve of FIG. 7 is divided into two halves because it shows depression of a key 14 to its contact point and its return, the depression part of the curve being marked A. B. C. D. The action of the wall 30 to a significant extent is that of a dished washer that turns inside out, but the wall 30 also deforms out-of-plane and folds on itself which contributes significantly to its physical characteristics. The combination of shortness, travel and height gives rise to the particular desirable physical characteristics. In travel from FIG. 5***a* to FIG. 5*b* the wall 30 deforms predominantly in plane by compression, but in travel from the 5*b* position to adjacent the center position of FIG. 5*c* distortion and folding of the wall 30 have occurred, corresponding to the shoulder in the region A–B of the curve of FIG. 7. As the button 40 passes over center (point B in FIG. 7) the wall 30 gives way and the button 40 passes through a position corresponding to FIG. 5*d* to a position corresponding to FIG. 5*e* before contact is made with the substrate (point C in FIG. 7). The reaction of the membrane, which has progressively increased in the region A–B, abruptly and substantially reducing after point B to give a pronounced change in tactile feel and inevitable travel to the contact position (point C). Thereafter the force increases rapidly with increasing travel corresponding to deformation of the material of the button rather than the wall until travel is complete at point D. In FIG. 7 the peak force A–D is 1 7 N, the return force 0.4 N and the differential (snap) force (B–C) is 0.87 N, where N is the force in Newtons.

FIGS. 6*a*–6*e* are similar but show collapse of the generally square button 40 under asymmetric pressure. As is apparent, on going from FIG. 6*a* to FIG. 6*b* the wall portion 30*a* which moves more because of the asymmetry compresses and deforms whereas wall 30*b* rocks and effectively acts as a hinge. At FIG. 6*c*, the wall portion 30*a* has passed overcenter whereas the wall portion 30*b* is still substantially straight and acts as a hinge. Collapse of wall 30*a* continues past the overcenter position through FIG. 6*d* to FIG. 6*e*, the wall 30*b* still remaining above the overcenter position and little distorted. The behaviour of the orthogonal pair of walls varies depending upon position from that of FIG. 6*a* to that of FIG. 6*b*. The action of the button 40 still has substantial tactility because the actin of the wall portion 30*a* at least remains substantially the same as when the finger pressure is symmetric. Tactility is retained also in the circular button under asymmetric pressure, but to a lesser degree.

We claim:

1. A keymat for use with a substrate or board having electrically conductive contact areas or surfaces thereon, wherein the keymat comprises a membrane of resiliently deformable material having at least one integrally formed dome key whose top surface constitutes a touch button joined to the membrane by a frusto-conical wall, and whose bottom surface has an electrically conductive contact area or surface thereon for contacting an underlying conductive surface on a substrate, for thus defining an electrical switch, and wherein:

(a) the membrane and at least the periphery of the touch button are relatively thick and the wall is relatively thin so that deformation during the keystroke is localized in the wall;

(b) the length of the wall is approximately equal to the keystroke; and (c) the junction between the wall and the membrane is located at a distance less than the keystroke below the junction between the wall and the touch button so that on depression of the touch button the wall deflects from its initial upstanding attitude through a dead-center condition and then suddenly collapses to provide a tactile feedback.

2. A keypad according to claim 1, wherein the junction between the wall and the membrane is located at a distance greater than the keystroke above the lower surface of the membrane.

3. A keypad according to claim 1, wherein the ratio of the thickness of the membrane to the thickness of the wall is from about 4:1 to about 10:1.

4. A keypad according to claim 3, wherein the ratio of the thickness of the membrane to the thickness of the wall is about 7:1.

5. A keypad according to claim 1, wherein the wall is directed at from 25° to 60° to the membrane when the key is undeflected.

6. A keypad according to claim 5, wherein the wall is directed at about 45° to the membrane when the key is undeflected.

7. A keypad according to claim 6, wherein the wall joins the membrane flush with its top surface and the membrane is at least 1.5 mm thick.

8. A keypad according to claim 7, wherein the the key stroke is about 0.7 mm to 2 mm.

9. A keypad according to claim 8, wherein the keystroke is about 1.3–1.4 mm.

10. A keypad according to claim 1, wherein the touch button is of low profile.

11. A keypad according to claim 10, wherein the maximum thickness of the touch button is less than half its width and the distance between the top surface of the touch button and the lower face of the membrane is less than three times the thickness of the membrane the thickness of the touch button being such that it does not substantially flex during the keystroke.

12. A keypad according to claim 11, wherein the undersurface of the touch button is disposed no higher than the top surface of the membrane when the touch button is undeflected.

13. A keypad according to claim 12, wherein the wall joins the touch button at least partway up the touch button.

14. A keypad according to claim 1, wherein the touch button presents a continuous curved lower face having a conductive surface that occupies most of its width, the radius of curvature of the conductive face being selected in relation to the length, the angle, the height of the wall junction with the membrane and the touch button size and travel so that when the keypad is placed in area contact with the substrate the conductive surface makes area contact with the conductive surface on the substrate over the full range of angles to which the touch button tilts when finger pressure is asymmetric.

15. A keypad according to claim 14, wherein the material of the membrane is transluscent in thin sections and the touch button presents a continuous top face and is formed with a cavity opening from its underside and defining an annular lower face, the cavity being spanned by an integral web that is thin enough to be transluscent and that defines portions of said top face.

16. A keypad according to claim 15, wherein the periphery of the touch button is formed with an upstanding wall inturned at its end to retain a disk of light-transmitting rigid material.

17. A keypad according to claim 16, wherein the touch button presents a convex conductive lower face.

18. A keypad according to claim 1, wherein the touch button is circular in plan.

19. A keypad according to claim 1, wherein the touch button is oval in plan.

20. A keypad according to claim 1, wherein the touch button is square in plan with radiused corners.

21. A keypad according to claim 1, wherein the touch button is rectangular in plan with radiused corners.

22. A keypad according to claim 1, wherein the touch button is polygonal in plan with radiused corners.

23. A two-component switch comprising a keymat arranged as a cover on a substrate or board having electrically conductive contact areas or surfaces thereon, and wherein the keymat comprises a membrane of resiliently deformable material having at least one integrally formed dome key whose top surface constitutes a touch button joined to the membrane by a frusto-conical wall, and whose bottom surface has an electrically conductive contact area or surface thereon for contacting the underlying conductive surface on the substrate, thus defining an electrical switch, and wherein:

(a) the membrane and at least the periphery of the touch button are relatively thick and the wall is relatively thin so that deformation during the keystroke is localized in the wall;

(b) the length of the wall is approximately equal to the keystroke; and (c) the junction between the wall and the membrane is located at a distance less than the keystroke below the junction between the wall and the touch button so that on depression of the touch button the wall deflects from its initial upstanding attitude through a dead-center condition and then suddenly collapses to provide a tactile feedback.

24. A switch according to claim 23, wherein the keypad membrane is formed with self-aligning retainer means engaging behind the substrate to hold the membrane in face to face contact with the substrate and in a predetermined position relative thereto, said retainer means tensioning the membrane and comprising a peripheral lip on the membrane into which the edges of the substrate locate.

25. A switch according to claim 19, wherein the retaining means further comprises studs projecting from the concealed face of the membrane that locate via through holes in the substrate.

26. A switch according to claim 20, wherein the conductive formations on the substrate are an array of interdigitated contact fingers defining a contact area under the touch button, and the underside of the touch button is conductive.

27. A switch according to claim 26, wherein there are a multiplicity of touch buttons, each individually colored or marked for identification.

28. A keypad for an electrical switch, in which the keypad is adapted to overlie a substrate having at least one electrically conductive contact area thereon, said keypad comprising a membrane of resiliently deformable material having at least one frusto-conical dome-shaped key molded therein so that its top surface constitutes a touch button, the touch button being connected to the membrane by a dome wall, the thickness and angle of the or of each dome wall relative to the touch button and the membrane being such that irrespective of the angle to which the touch button tilts when depressed, the wall gives way to give a change in tactile sensation without substantially deforming the surrounding membrane or touch button, the thickness of the membrane being greater than the distance the button tilts or travels before the respective dome wall inverts, and said key having electrically conductive means on a bottom surface thereof for contact with a contact area on a substrate.

29. A keypad as claimed in claim 28, wherein the touch button is of a thickness such that the touch button does not substantially flex when depressed at least until after the change in tactile sensation.

30. A keypad according to claim 24, wherein the membrane and touch button are of substantially the same thickness and the undersurface of the touch button is conductive and convex and is disposed no higher than the line of the top surface of the membrane.

* * * * *